US011420810B1

(12) United States Patent
Wise

(10) Patent No.: US 11,420,810 B1
(45) Date of Patent: Aug. 23, 2022

(54) REFILLABLE SOLUTION DISPENSING DEVICE

(71) Applicant: Robert Wise, Penngrove, CA (US)

(72) Inventor: Robert Wise, Penngrove, CA (US)

( * ) Notice: Subject to any disclaimer, the term of this patent is extended or adjusted under 35 U.S.C. 154(b) by 0 days.

(21) Appl. No.: 17/223,156

(22) Filed: Apr. 6, 2021

Related U.S. Application Data

(63) Continuation-in-part of application No. 17/018,691, filed on Sep. 11, 2020, now Pat. No. 11,253,882.

(51) Int. Cl.
*B05B 11/00* (2006.01)
*B65D 83/42* (2006.01)

(52) U.S. Cl.
CPC ..... *B65D 83/42* (2013.01); *B05B 11/0054* (2013.01); *B05B 11/0081* (2013.01); *B05B 11/0097* (2013.01)

(58) Field of Classification Search
CPC ..... B05B 11/3039; B05B 11/0054; B05B 11/3052; B05B 11/0078; B05B 11/0038; B05B 11/0081; B05B 7/0416; B05B 7/0425; B05B 7/2443; B05B 7/2454; B05B 7/28; B05B 7/262; B05B 7/267; B65D 81/3211; B65D 81/3222; B65D 81/325; B65D 81/3255; B67D 1/1288; B67D 1/0037; B67D 1/105
USPC ..... 222/383.1, 321.7, 129, 136, 130, 135, 222/226, 240, 190
See application file for complete search history.

(56) References Cited

U.S. PATENT DOCUMENTS 1,519,664 A * 12/1924 Campbell ..... F04D 1/12 415/72
1,845,429 A * 2/1932 Lorenz ..... F16N 13/00 222/240
1,930,872 A * 10/1933 Blackmun ..... B05B 11/3087 239/355
1,956,788 A * 5/1934 Blum ..... B67D 1/10 222/383.2
5,018,643 A * 5/1991 Bolduc ..... B65D 83/687 222/129
5,255,851 A * 10/1993 Tobler ..... B65D 83/754 239/590.5
5,433,343 A * 7/1995 Meshberg ..... B05B 7/02 222/25
5,509,578 A * 4/1996 Livingstone ..... B05B 11/0038 222/321.6

(Continued)

*Primary Examiner* — Charles P. Cheyney
(74) *Attorney, Agent, or Firm* — Boudwin Intellectual Property; Daniel Boudwin

(57) ABSTRACT

A refillable solution dispensing device includes a housing having an upper section and a lower section. An actuator exposed through the exterior of the upper section. The actuator is movably connected to an air chamber and a solution chamber. The solution chamber is in fluid communication with the solution reservoir and a discharge nozzle. The air chamber is fluidly connected to the discharge nozzle. The actuator is coupled to a mixing shaft that protrudes into the lower section. The lower section comprises an interior volume that functions as a solution reservoir. A solution cartridge and water are inserted into the solution reservoir. A solution mixer is rotatably coupled to the mixing shaft combining the solution within the solution cartridge, the solution cartridge, and the water into one solution. Upon an activation of the actuator, the solution and the air will mix and exit the discharge nozzle.

20 Claims, 9 Drawing Sheets

(56) References Cited

U.S. PATENT DOCUMENTS

| | | | | |
|---|---|---|---|---|
| 8,348,096 | B2 * | 1/2013 | Greiner-Perth | B05B 11/307 222/386 |
| 10,492,648 | B1 * | 12/2019 | Pimentel | A47K 5/12 |
| 2015/0274398 | A1 * | 10/2015 | Kim | B65D 81/325 222/129 |
| 2016/0249725 | A1 * | 9/2016 | Hasegawa | A45D 34/00 222/96 |
| 2017/0348714 | A1 * | 12/2017 | Lee | B65D 81/32 |
| 2018/0279743 | A1 * | 10/2018 | Yoo | B05B 11/0081 |

* cited by examiner

REFILLABLE SOLUTION DISPENSING DEVICE

CROSS REFERENCE TO RELATED APPLICATIONS

This Application is a Continuation in part of U.S. application Ser. No. 17/018,691 filed on Sep. 11, 2020. The above identified patent application is herein incorporated by reference in its entirety to provide continuity of disclosure.

BACKGROUND OF THE INVENTION

The present invention relates to solution dispensing devices. More particularly, the present invention provides a refillable solution dispensing device.

Currently, many solution dispensers include a solution that is placed into a can and dispensed with an aerosol product. The currently available solution containers are a 'single use' container. When the solution with the container is completely used and the container is empty, the user will discard the container. These currently available solution containers produce a large amount of waste. This waste is deposited in landfills to eventually one day break down. Even after the cans break down, the residual, potentially harmful interior material is then released into the soil or air. This can cause further damage to an area of land.

Specifically, traditional aerosol cans use dangerous gases to pressurize the cans. In some instances, these gases are only harmful to the overall environment. In other instances, these gases are poisonous to humans. These gases may cause damages to a body or even cause cancer. These gases may even be deadly if inhaled. The combination of gases and having sealed metal cans means that refilling these items is not an option.

Many times, solutions in these cans tend to separate over time. This means that the solutions used often change in consistency over time and become weaker. Many times, the currently available solution containers instruct the user to manually mix the solution by shaking the solution container prior to use. This attempts to mix the solution to reduce the separation effects. The user may not properly mix the solution. Moreover, this shaking is often unsuccessful and does not properly mix the solution.

Consequently, there is a need for an improvement in the art of solution dispensers. The present invention substantially diverges in design elements from the known art while at the same time solves many environmental issues with current dispensers. In this regard the present invention substantially fulfills these needs.

SUMMARY OF THE INVENTION

The present invention provides a refillable solution dispensing device wherein the same can be utilized for providing convenience for the user when using a refillable solution dispensing device. The refillable solution dispensing device comprises a housing having an upper section and a lower section. The upper section further comprises an actuator exposed on the exterior of the upper section and is connected to an actuator body on the interior of the upper section. The actuator body is movably connected to at least a first air chamber and at least one solution chamber. The at least one solution chamber is in fluid communication with the solution reservoir at one end and a discharge nozzle at another end. The first air chamber is fluidly connected to the discharge nozzle. The actuator body includes a mixing shaft that protrudes into the lower section. The lower section comprises and interior volume that functions as a solution reservoir. A solution mixer is rotatably coupled to the mixing shaft.

Another object of the refillable solution dispensing device is to have more than one air chamber affixed to the actuator body. The air chambers are in fluid communication with the discharge nozzle.

Another object of the refillable solution dispensing device is to have a protruding cylinder secured to the bottom of the actuator body. The actuator body protrudes into the lower section.

Another object of the refillable solution dispensing device is to have an output selector which extends through the upper section and is operably coupled to the at least one solution chamber. The output selector controls the amount of solution which exits the device on each use.

Another object of the refillable solution dispensing device is to have a first pressure adjustment valve secured to a lower side of the first air chamber. The first pressure adjustment valve controls the pressure of the first air chamber.

Another object of the refillable solution dispensing device is to have a second pressure adjustment valve secured to a lower side of the second air chamber. The second pressure adjustment valve controls the pressure of the second air chamber. Additionally, in embodiments of the refillable solution dispensing device wherein there are more than two air chambers, a pressure adjustment valve will be secured to the lower side of each air chamber.

Another object of the refillable solution dispensing device is to have varying combinations of more than one solution chamber or air chamber that exits the device thru one pressure adjustment valve.

Another object of the refillable solution dispensing device is to have the upper section and the lower section which are removably secured together.

Another object of the refillable solution dispensing device is to have an actuator body which further comprises a spring. The spring will return the actuator body to an extended position after a press of the actuator.

Another object of the refillable solution dispensing device is to have an actuator body which houses the mixing shaft and the mixing device.

Another object of the refillable solution dispensing device is to have the mixing shaft which is connected to the mixing device via threads. The threads cause the mixing device to rotate upon a press from the actuator.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
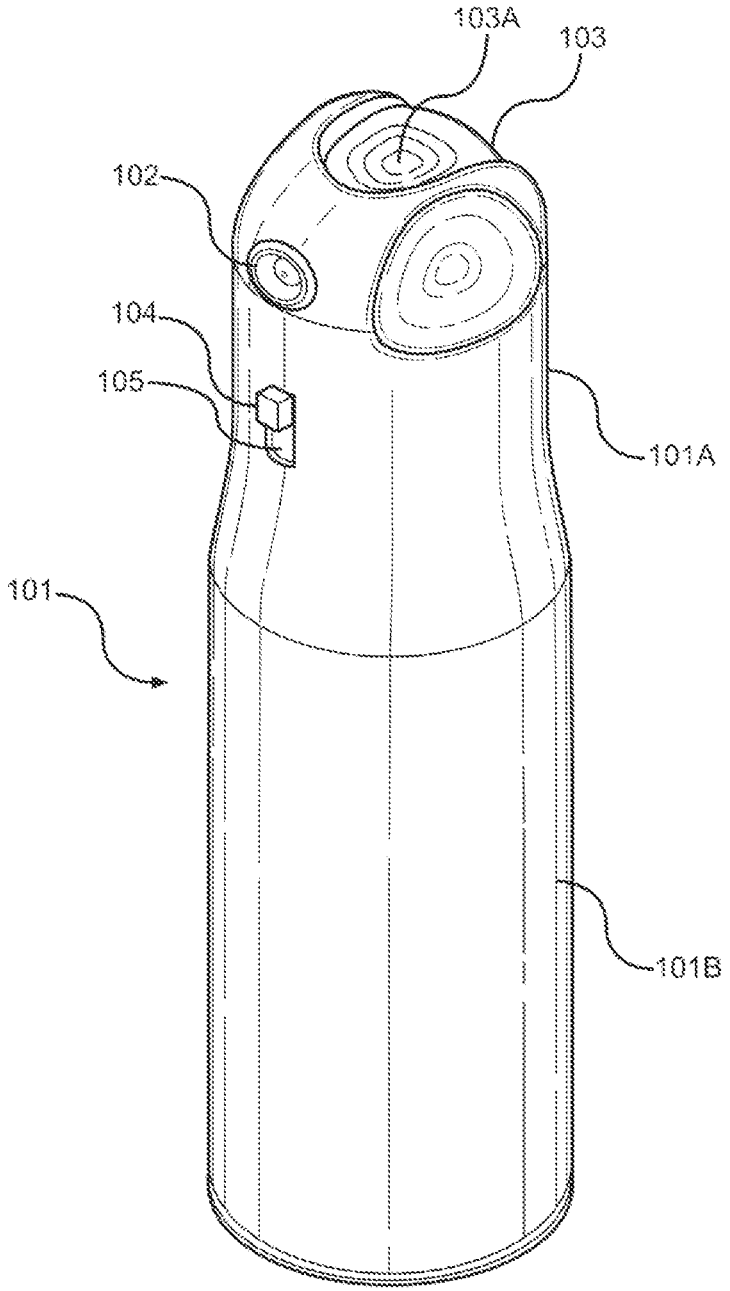
FIG. 1 shows a perspective view of an embodiment of the refillable solution dispensing device.

Reference is made herein to the attached drawings. Like reference numerals are used throughout the drawings to depict like or similar elements of the refillable solution dispensing device. For the purposes of presenting a brief and clear description of the present invention, a preferred embodiment will be discussed as used for the refillable solution dispensing device. The figures are intended for representative purposes only and should not be considered to be limiting in any respect.

Referring now to FIG. 1, there is shown a perspective view of an embodiment of the refillable solution dispensing device. The refillable solution dispensing device comprises a housing 101 having an upper section 101A and a lower section 101B. The upper section 101A and the lower section 101B are secured together as will be described in the description of FIG. 2. When the upper section 101A is secured to the lower section 101B, a seal between the upper section 101A and the lower section 101B is formed. In one embodiment, the housing 101 is a cylindrical housing. This will allow the device to be easily held in one hand. While other shapes are plausible as part of this disclosure, a cylinder is the most common for these articles. In one embodiment, the housing 101 narrows toward a top end of the housing. This will allow for the lower section 101B to be larger than the upper section 101A. The lower section 101B allows for additional solution to be placed into the dispenser.

The upper section 101A includes a discharge nozzle 102 in fluid communication with the interior of the dispenser. The connections of the discharge nozzle 102 will be described in the description of FIG. 3 and FIG. 4. The discharge nozzle 102 will allow for the contents of the refillable solution dispenser to be expelled from the device. In one embodiment, the discharge nozzle 102 has an adjustable output. In one embodiment, the discharge nozzle 102 will produce a stream flow. In another embodiment, the discharge nozzle 102 will produce a planar spray. In yet another embodiment, the discharge nozzle 102 will produce a cloud spray. In another embodiment, the discharge nozzle 102 will produce a steam of liquid.

In a further embodiment, the housing 101 has an actuator 103 located on a top of the upper section 101A. The actuator 103 movably exposed through the exterior of the upper section 101A as described in FIG. 3 and FIG. 4. In the shown embodiment the actuator 103 is a push button. The push button 103 is movable such that it enters the housing 101 when pushed toward the housing 101. In this embodiment, the actuator 103 has a depression 103A thereon. This will allow a finger to be placed in the depression 103A and to remain fixed in position without sliding from the actuator 103. In another embodiment of the refillable solution dispensing device, the actuator 103 is a lever. In yet another embodiment of the refillable solution dispensing device, the actuator 103 is a trigger. Moreover, the actuator 103 may be any combination thereof.

In one embodiment, the exterior of the housing 101 includes an output selector 104. The output selector 104 will control the amount of solution that is dispensed when the actuator 103 is engaged. The output selector 104 will be in contact with the dispensing devices as described in FIG. 3 and FIG. 4. In one embodiment, the output selector 104 is a sliding knob that protrudes from the housing 101. In a further embodiment, the output selector 104 is located through a channel 105 of the housing 101. The output selector 104 extends through the upper section 101*a* and is operably coupled to the solution chamber 303. In one embodiment, there are indicia located on the housing 101 adjacent to the output selector 104, which will correspond to the amount of solution dispensed when the output selector 104 is in a specific location.

Figure 2:
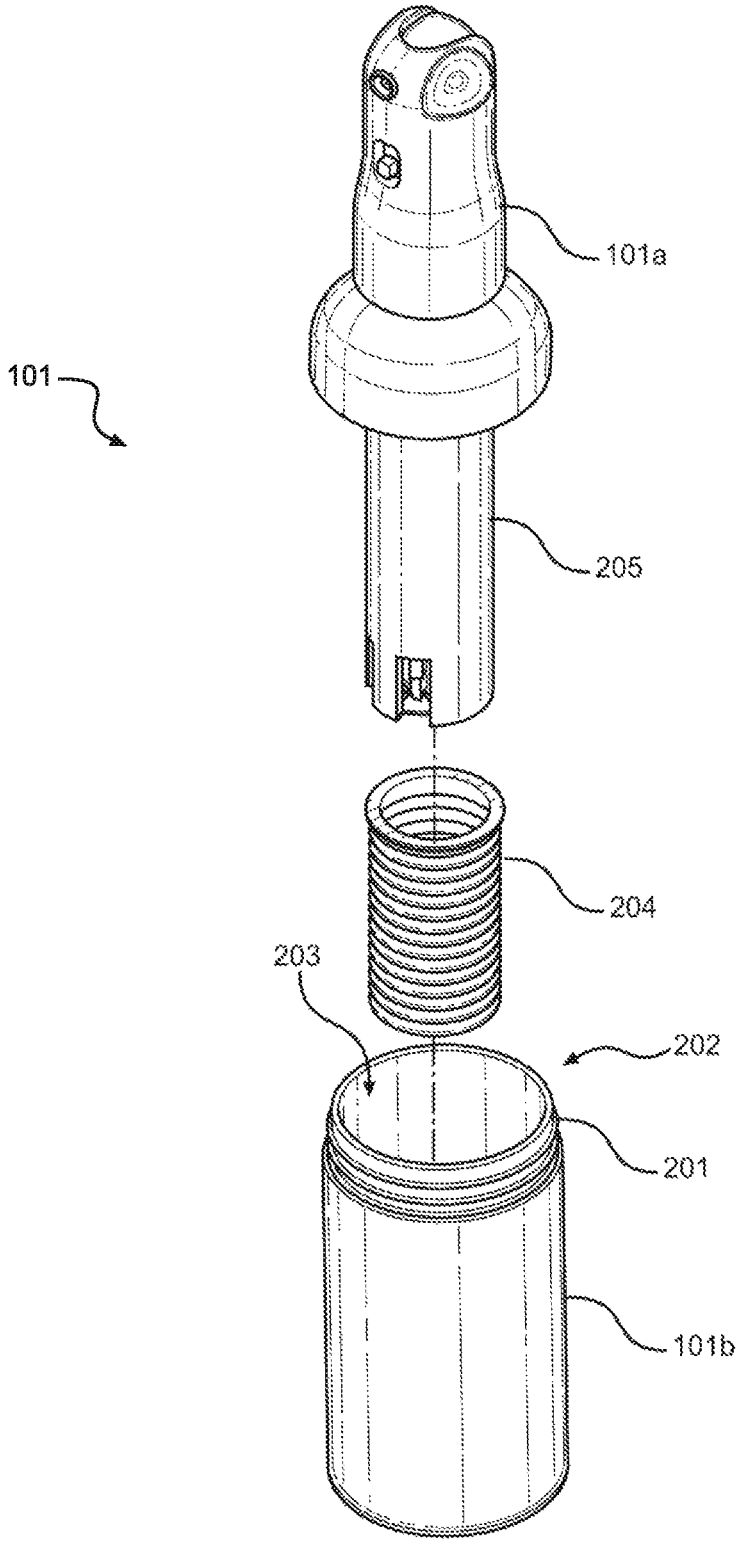
FIG. 2 shows a partially exploded view of an embodiment of the refillable solution dispensing device.

Referring now to FIG. 2, there is shown a partially exploded view of an embodiment of the refillable solution dispensing device. In this view, the upper section 101*a* of the housing 101 and the lower section 101*b* of the housing 101 are separated. In this embodiment, a threading 201 is shown about an upper edge 202 of the lower section 101*b*. The interior of the upper section 101*a* has a corresponding threading. This will allow the upper section 101*a* to be threaded onto the lower section 101*b*. In another embodiment, the upper section 101*a* and the lower section 101*b* have a snap connection.

The lower section 101*b* has an interior volume. In one embodiment, this interior volume functions as a solution reservoir 203. In another embodiment, there is an additional item located within the lower section which functions as a solution reservoir. The solution reservoir 203 will hold a liquid solution.

In one embodiment, the solution is poured directly into the solution reservoir 203. In another embodiment, a solution cartridge 204 is placed within the solution reservoir 203. The solution cartridge 204 as described in FIG. 7. In one embodiment, the solution cartridge 204 will hold the solution and the solution will be expelled from the solution cartridge 204.

In another embodiment, the upper section 101*a* includes a protrusion 205. In one embodiment, the protrusion 205 is a cylindrical protrusion. The protrusion 205 will fit within the lower section 101*b* when the upper housing 101*a* is secured thereto. In one embodiment, the protrusion 205 will crush the solution cartridge 204, thereby expelling the solution into the solution reservoir 203. In one embodiment, the solution cartridge 204 comprises a plurality of pleats therein, defining an accordion shape. This will allow for the solution cartridge 204 to collapse.

Figure 7:
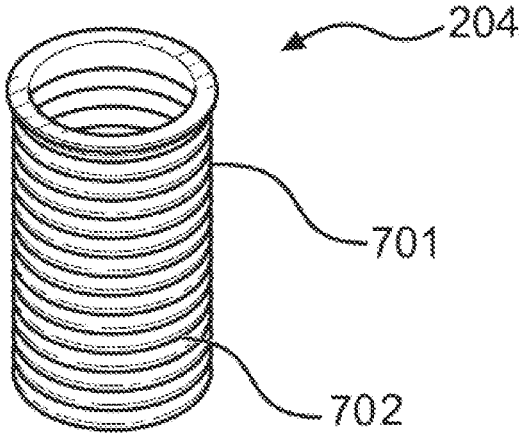
FIG. 7 shows a perspective view of an embodiment of the solution cartridge.

Referring now to FIG. 7, there is shown a perspective view of an embodiment of a solution cartridge. The solution cartridge 204 comprises a defined body 701 and structural elements that allows for the defined body 701 to compress. In this embodiment, the solution cartridge 204 comprises a plurality of pleated ribs 702 therein, defining an accordion shape. The plurality of pleated ribs provides the defined body 701 with a larger surface area to advance the dissolving process of the solution cartridge 204. The solution cartridge 204 comprises concentrates including alcohols, ethanol, oils, and water. In one embodiment, the solution cartridge 204 is made from plastic. In another embodiment, the solution cartridge 204 is composed of varying formulas of polyvinyl alcohol. The solution cartridge 204 is water soluble and can dissolve when water is added to the lower section reservoir 203. The solution cartridge 204 further comprises a protective outer sealer. The protective outer sealer may be composed of a biodegradable printable cellophane or an organic based plastic. The protective outer sealer encases the solution cartridge 204 to prevent relative humidity, water vapor transmission, and other moisture damage to the solution cartridge 204 prior to use.

Figure 3:
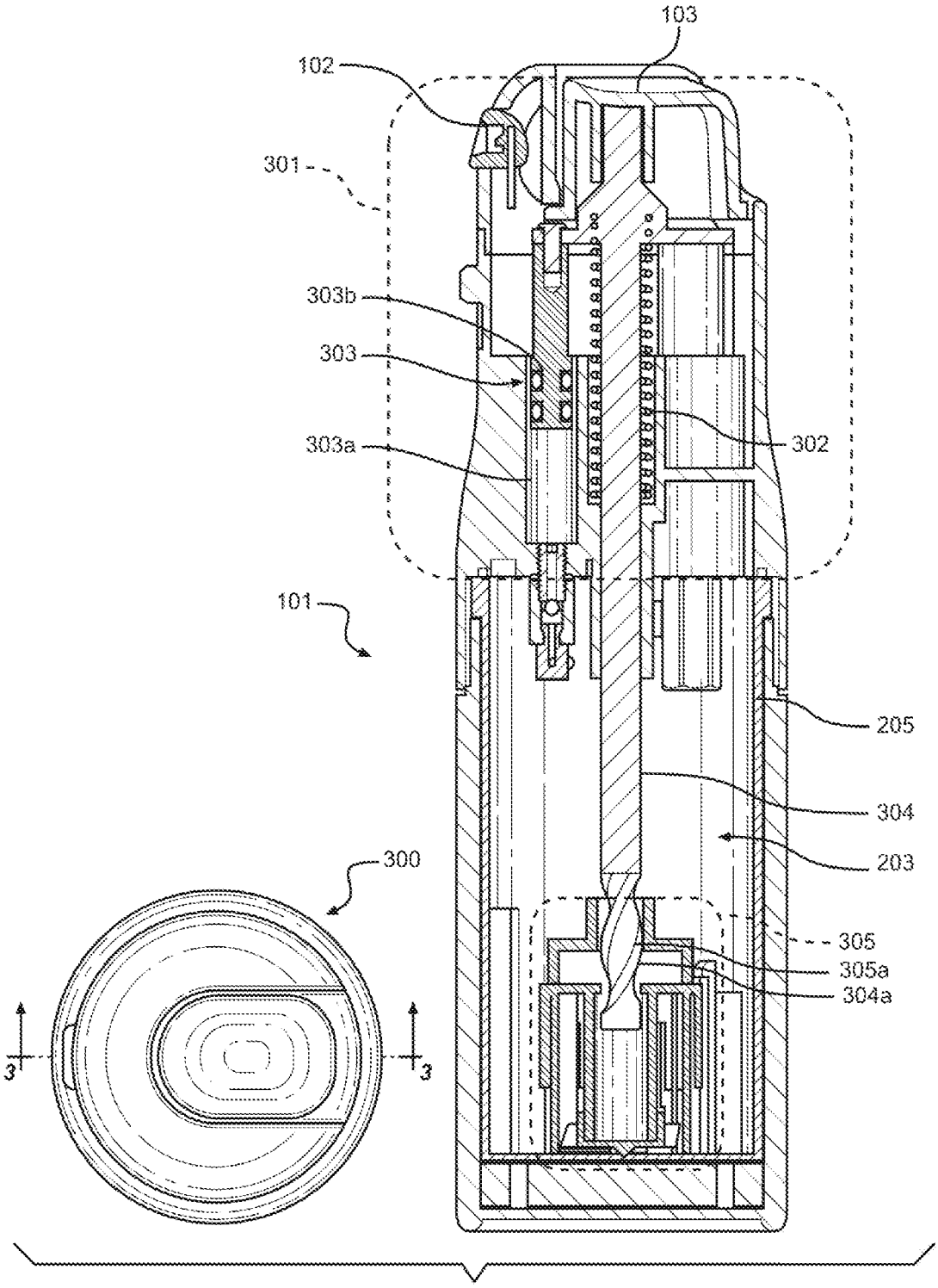
FIG. 3 shows a cross-sectional view of an embodiment of the refillable solution dispensing device.

Referring now to FIG. 3, there is shown a cross-sectional view of an embodiment of the refillable solution dispensing device. Please also see FIG. 5 in coordination with FIG. 3. The refillable solution dispensing device includes an actuator body 301. The actuator body 301 is coupled to the actuator 103. When the actuator 103 is engaged the actuator body 301 moves with the actuator 103. The end of the actuator body 301 rotatably opens the top of the solution cartridge 204 when upper section 101*a* is attached to lower section 101*b*. In one embodiment, at least one spring 302 is included as part of the actuator body 301. The at least one spring 302 will bias the actuator body 301 toward the top of the device. This will allow the actuator 103 and the actuator body 301 to reset to an extended position after pressed into a retracted position.

The refillable solution dispensing device includes at least one solution chamber 303. The at least one solution chamber 303 is comprising a solution housing 303*a* and a piston 303*b*. The at least one solution chamber 303 is secured to the actuator body 301 at one end and the housing 101 at another end. This will allow the piston 303*b* to be depressed and reset along with the actuator body 301. The at least one solution chamber 303 is in fluid communication with the discharge nozzle 102. This is represented by hose 501 in FIG. 5. One of ordinary skill in the art will recognize that the hose 501 is flexible and will not impede the movement of the actuator 103. When the piston 303*a* is depressed, the solution exits the at least one solution chamber 303 and is expelled from the discharge nozzle 102. The at least one solution chamber 303 is further in fluid communication with the solution reservoir 203. When the piston 303*b* is extended out of the solution housing 303*a*, the solution housing 303*a* fills with solution. There is a one way valve that will prevent the solution for re-entering the solution reservoir 203 when the piston 303*b* is depressed. In one embodiment, the piston 303*a* creates a seal with the solution housing 303*b*. This will create the suction needed to draw solution from the solution reservoir 203 into the solution housing 303*b*.

The at least one solution chamber 303 includes a one way valve secured to the solution housing 303*a*. The one way valve will allow solution to be drawn into the solution housing 303*a* from the solution reservoir 203. The one way valve will further prevent solution from being dispelled back into the solution reservoir 203. The at least one solution chamber 303 will further include a pressure valve. The pressure valve will open once the solution reaches a predetermined pressure within the solution housing 303*a*. The pressure valve discharges the air or solution at prescribed pressure upon activating the actuator 103, via the discharge nozzle 102.

In one embodiment, the actuator body 301 includes a mixing shaft 304. The mixing shaft 304 moves with the actuator body 301. The mixing shaft 304 is of a length that allows it to enter the lower section 101*b* of the housing 101 when the upper section 101*a* and the lower section 101*b* are secured together. In one embodiment, the mixing shaft 304 serves to hold the at least one spring 302 in place and allows the mixing shaft 304 to properly bias the actuator body 301 toward the top of the housing 101. In different embodiments the spring 302 is not located around the mixing rod 304. For example, in one embodiment, the is a plurality of springs 302 located around the interior perimeter of the actuator 102. The mixing shaft 304 is further secured to a mixing device 305. In one embodiment, the mixing device 305 is secured to an end of the mixing shaft 304. The mixing device 305 will mix the solution within the solution reservoir 203. The mixing shaft 304 further comprises a bypass switch. The bypass switch enables the mixing shaft 304 to operate without discharging air or solution. The bypass switch will mix the solutions, the water, and the water soluble solution cartridge within the solution reservoir 203.

In one embodiment, the mixing shaft 304 is movably secured to the mixing device 305. In one embodiment, the mixing shaft 304 has a threaded end 304*a*. The mixing device 305 has a corresponding threading 305*a*. When the mixing shaft 304 enters the mixing device 305 as the actuator 103 is engaged, then the mixing device 305 will spin. In one embodiment, the threaded end 304*a* of the mixing shaft 304 and the corresponding threading 305*a* of the mixing device 305 will disengage when the actuator body 301 is in the extended position. This will allow the mixing device 305 to continue spinning after each activation of the actuator 103.

In one embodiment, the mixing shaft 304 is extended into the protrusion 205 of the upper section 101*a*. Further, in one embodiment, the mixing device 305 is rotatably secured within the protrusion 205. In another embodiment, the protrusion 205 includes a housing 205*a* which will secure the mixing device. This will ensure that the mixing device 305 will stay at a lower section of the solution reservoir 203 to adequately mix the solution.

The activation of the mixing device 305 on the depression of the actuator body 301 will have additional benefits. The solution enters the at least one solution chamber 303 when the actuator body 301 is extended. This means that already mixed solution will enter the at least one solution chamber 303. This ensures that each time solution is dispensed as an evenly mixed solution. This further ensures that the solution does not dilute throughout the use of the dispenser. Moreover, the mixing shaft 304 extracts the air or the solution, or a combination thereof, from the solution reservoir 203 to a chamber.

In one embodiment, the dispensing device includes additional solution chambers. The additional solution chambers are configured similar to the at least one solution chamber described above. Each additional chamber will be fluidly connected to a solution reservoir 203 and the discharge nozzle 102. Further, each additional solution chamber will be connected to the actuator 103 and the housing 101. In one embodiment, the additional solution chambers are of different volumes. This will allow for different solutions to be mixed together creating one discharge. In another embodiment the solution chambers are connected to separate solution reservoirs. This will allow for different combination of premixed prescribed solution and air. The combination of premixed prescribed solution and air within the chambers will exit through the discharge nozzle 102.

Figure 4:
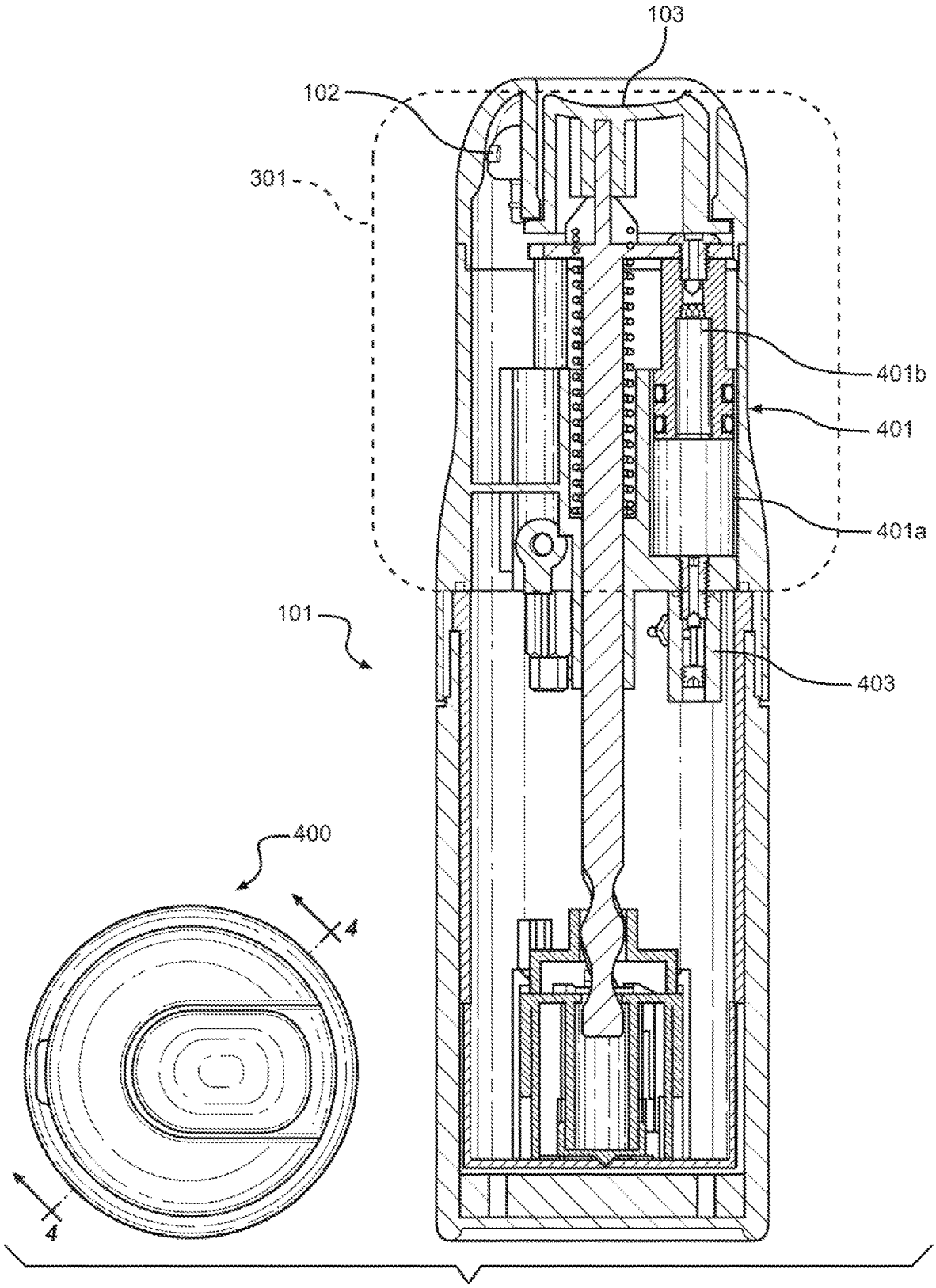
FIG. 4 shows a cross-sectional view of an embodiment of the refillable solution dispensing device.

Referring now to FIG. 4, there is shown a cross-sectional view of an embodiment of the refillable solution dispensing device. Please also see FIG. 5 in coordination with FIG. 4. The refillable solution dispensing device includes a first air chamber 401. The first air chamber 401 is comprising an air housing 401*a* and a piston 401*b*. The first air chamber 401 is secured to the actuator body 301 at one end and the housing 101 at another end. This will allow the piston 401*b* to be depressed and reset along with the actuator body 301.

The first air chamber 401 is in fluid communication with the discharge nozzle 102. This is represented by hose 501 in FIG. 5. One of ordinary skill in the art will recognize that the hose 501 is flexible and will not impede the movement of the actuator 103. When the piston 401*a* is depressed the air is forced from the air chamber 401 and is expelled from the discharge nozzle 102. When the piston 401*b* is extended out of the first air chamber 401, the first air housing 401*a* fills with air. There is a one way valve that will prevent the air from exiting the piston the way it came in when the piston 401*b* is depressed.

The air housing 401*a* of the first air chamber 401 has an air pressure adjustment valve 403 secured thereto. This will allow for the volume of the air housing 401*b* to be increased or decreased. This will determine the pressure at which the solution will be expelled from the device. In one embodiment, the air pressure adjustment valve 403 is a turn knob which will rise and lower the base of the air housing 401*b*.

In some embodiments, the first air chamber 401 includes a one way valve secured to the air housing 401*a*. The one way valve will allow air to be drawn into the air housing 401*a*. The one way valve will further prevent air from being dispelled through the same valve. In another embodiment, the air housing 401*a* will further include a pressure valve. The pressure valve will open once the air within the air housing 401*a* reaches a predetermined pressure, releasing the air to the discharge nozzle 102.

Figure 5:
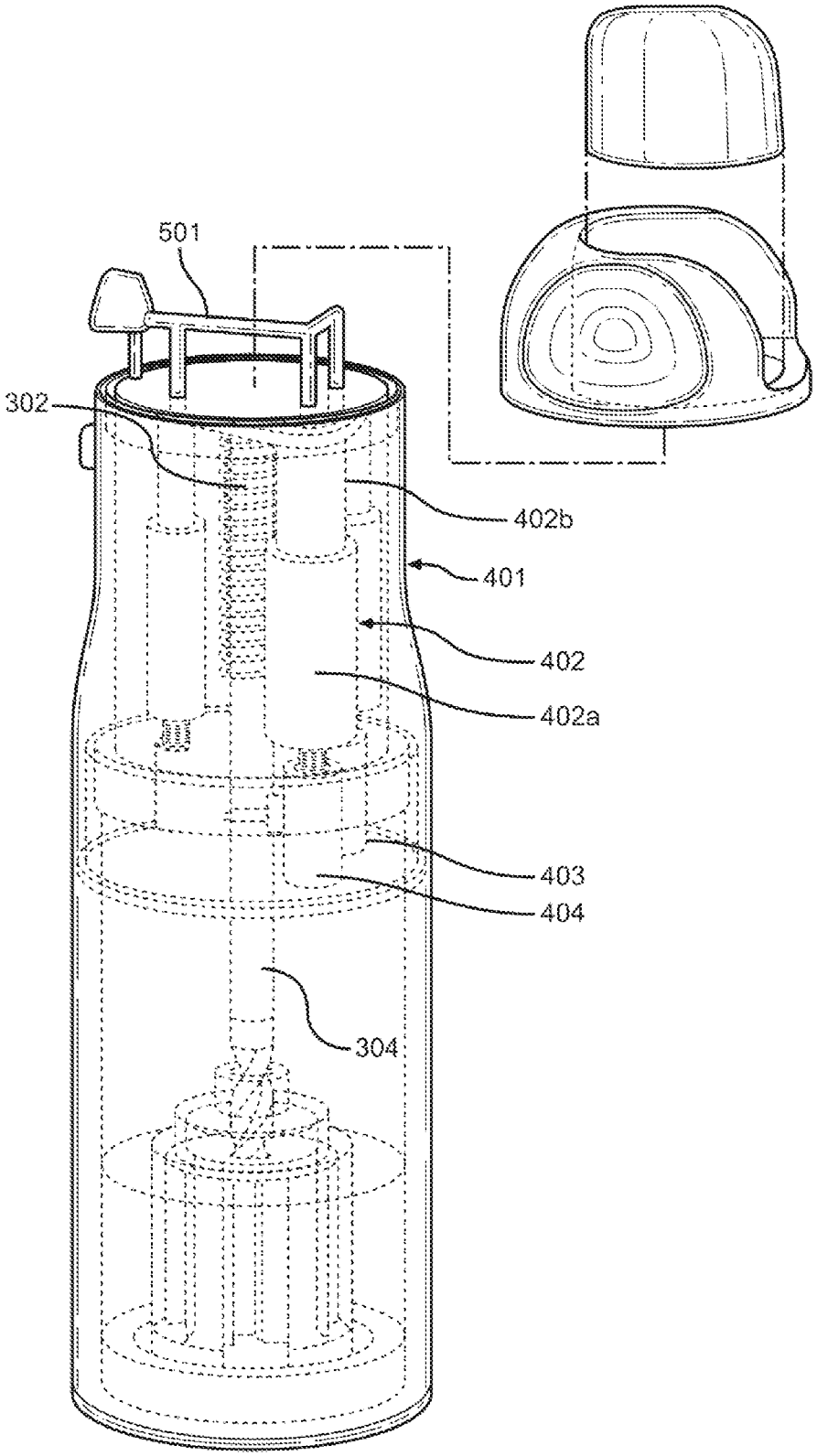
FIG. 5 shows an internal view of an embodiment of the refillable solution dispensing device.

In a further embodiment, seen specifically in FIG. 5, the refillable solution dispensing device includes a second air chamber 402. The second air chamber 402 is comprising an air housing 402*a* and a piston 402*b*. The second air chamber 402 is secured to the actuator body 301 at one end and the housing 101 at another end. This will allow the piston 402*b* to be depressed and reset along with the actuator body 301. The second air chamber 402 is in fluid communication with the discharge nozzle 102. This is represented by hose 501 in FIG. 5. One of ordinary skill in the art will recognize that the hose 501 is flexible and will not impede the movement of the actuator 103. When the piston 402*a* is depressed the air is forced from the air chamber 402 and air is expelled from the discharge nozzle 102. When the piston 402*b* is extended out of the second air chamber 402, the second air housing 402*a* fills with air. There is a one way valve that will prevent the air from exiting the air chamber 402 the way it came in when the piston 402*b* is depressed.

The air housing 402*a* of the second air chamber 402 has an air pressure adjustment valve 404 secured thereto. This will allow for the volume of the air housing 402*b* to be increased or decreased. This will determine the pressure at which the solution will be expelled from the device. In one embodiment the air pressure adjustment valve 404 is a turn knob which will rise and lower the base of the air housing 402*a*.

In some embodiments, the second air chamber 402 includes a one way valve secured to the air housing 402*a*. The one way valve will allow air to be drawn into the air housing 402*a*. The one way valve will further prevent air from being dispelled through the same valve. In another embodiment the air chamber 402*a* will further include a pressure valve. The pressure valve will open once the air within the air chamber 402*a* reaches a predetermined pressure, releasing the air to the discharge nozzle 102.

In this embodiment, the first air chamber 401 and the second air chamber 402 work together. In one embodiment, this will allow the solution to be expelled from the dispenser with a greater pressure. In another embodiment, this will allow for less stress to be put on each air chamber 401, 402. In yet a further embodiment, the dual air chambers 401, 402 will allow for redundancy. This means that even if one were to fail, the other could take its place. This would allow the dispenser to still function even if an air chamber 401 becomes damaged.

When the actuator 103 is activated, depressed air and varying solutions are mixed together in the fluid connects between the respective chambers and the discharge nozzle, as represented by 501. This will allow for the solution to be dispensed in a number of different ways. Further, in some embodiments this will allow for different solutions to be mixed before exiting the discharge nozzle 102.

Figure 6:
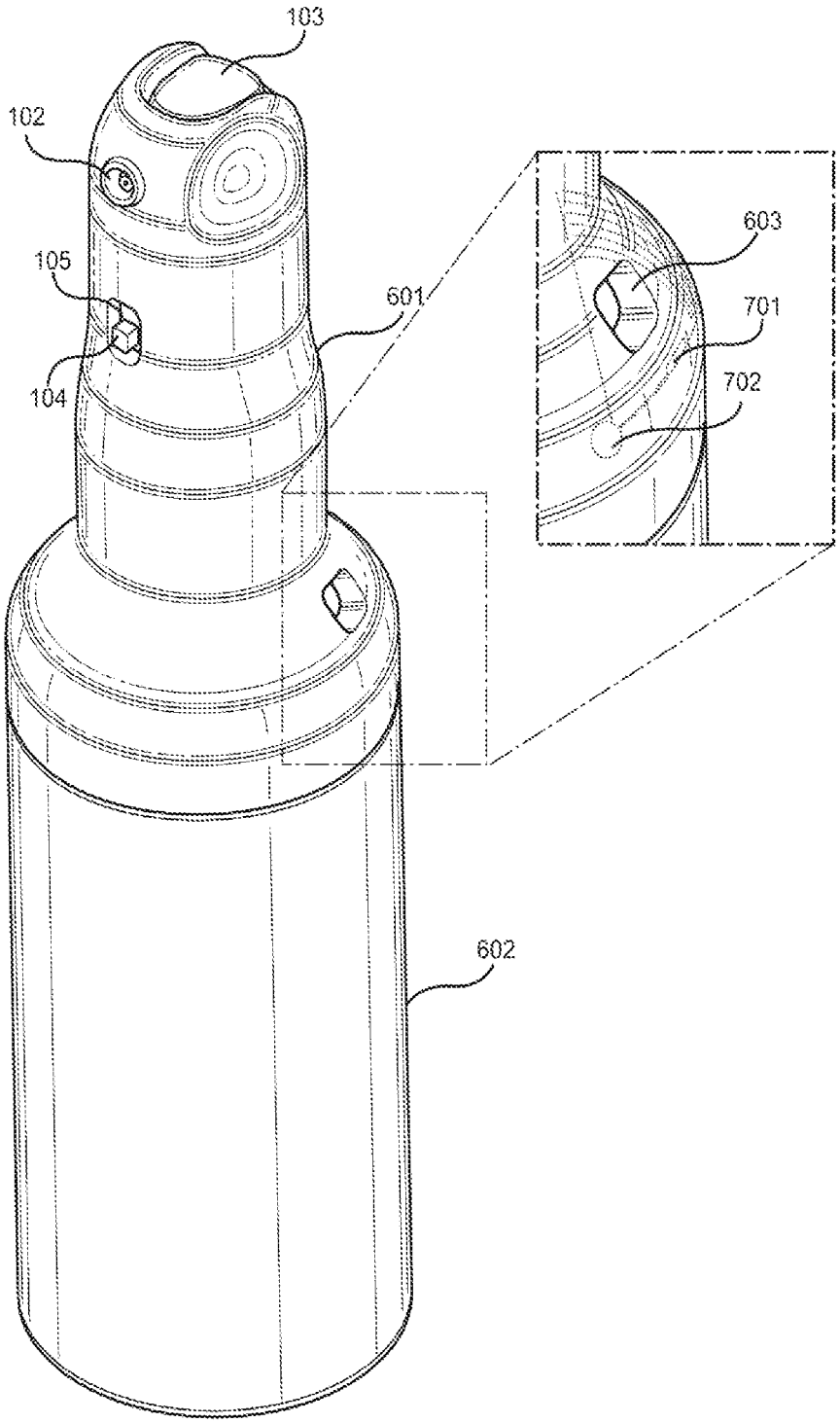
FIG. 6 shows a perspective view of an alternative embodiment of the housing of the refillable solution dispensing device.

Referring now to FIG. 6, there is shown a perspective view of an alternative embodiment of the housing of a refillable solution dispensing device. The alternative embodiment of the refillable solution dispensing device includes an opening 603. The opening 603 is disposed through the top section 601 of the housing. The opening 603 is in fluid communication with the interior volume of the dispenser. In one embodiment the opening 603 will allow for liquid to be placed within the solution reservoir. In one embodiment the opening 603 has a cap.

In another embodiment, the opening 603 will have an automatic closure device. In the shown embodiment the closure device includes a float device 701. The float device 701 will float up as liquid is added to the dispenser. The float device 701 is attached to the interior the upper section 601 using a hinge 702. The hinge connection will allow the float device 701 to rise and lower with the liquid level.

When the liquid is filled with the prescribed amount of solution the float device 701 will cause the opening 603 to be closed. In one embodiment, the float device 701 will seal the opening 603 closed by contacting the interior edge of the opening 603. In another embodiment the float device 701 will engage a secondary closure device. The secondary closure device will then close the opening 603. In a further embodiment, the method of closure will become locked into place until disengaged. In this embodiment, the disengagement will happen when the device is separated.

Figure 8:
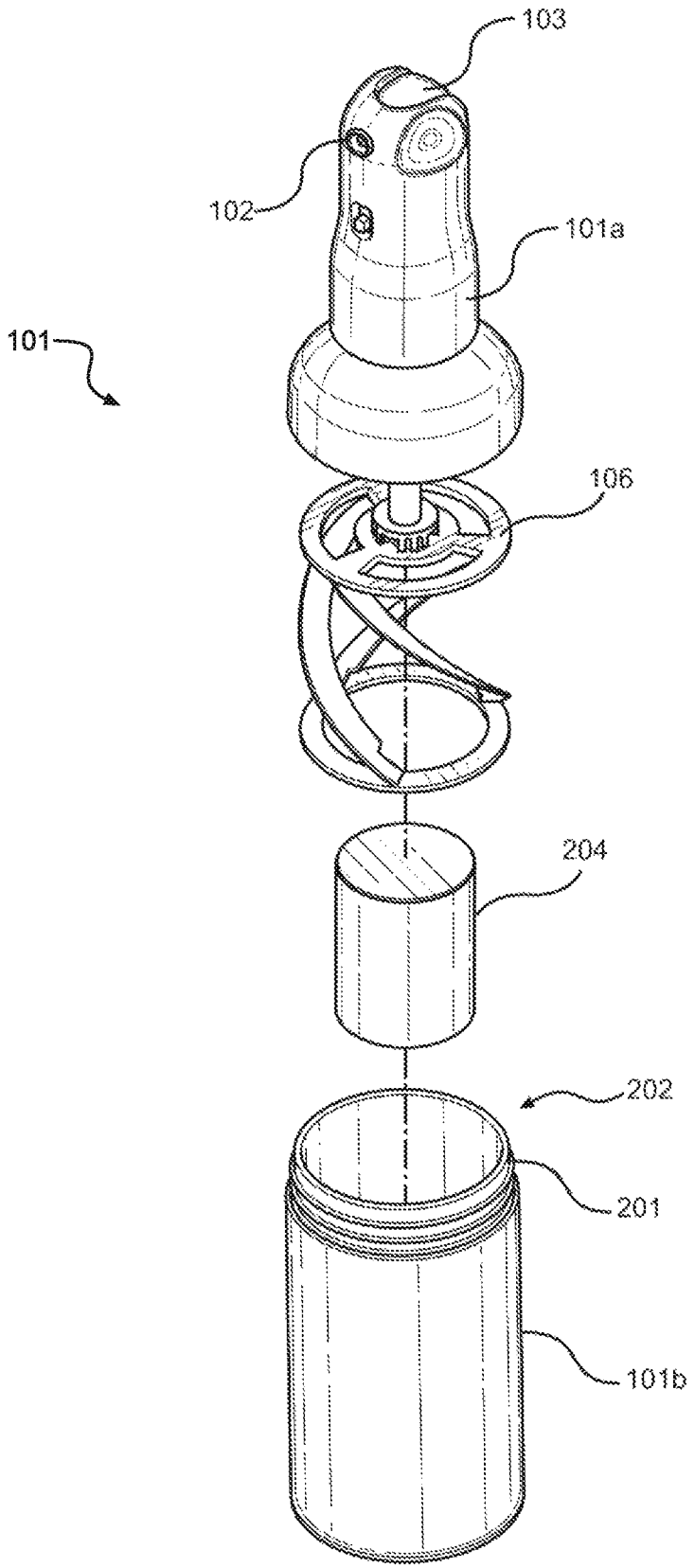
FIG. 8 shows a partially exploded view of an alternative embodiment of the refillable solution dispensing device.

Referring now to FIG. 8, there is shown a partially exploded view of an alternative embodiment of the refillable solution dispensing device. In this view, the upper section 101*a* of the housing 101 and the lower section 101*b* of the housing 101 are separated. In this embodiment, a threading 201 is shown about an upper edge 202 of the lower section 101*b*. The interior of the upper section 101*a* has a corresponding threading. This will allow the upper section 101*a* to be threaded onto the lower section 101*b*. In another embodiment, the upper section 101*a* and the lower section 101*b* have a snap connection.

The lower section 101*b* has an interior volume. In one embodiment, this interior volume functions as a solution reservoir 203. In another embodiment, there is an additional item located within the lower section which functions as a solution reservoir. The solution reservoir 203 will hold a liquid solution.

In one embodiment, the solution is poured directly into the solution reservoir 203. In another embodiment, a solution cartridge 204 is placed within the solution reservoir 203. In one embodiment, the solution cartridge 204 will hold the solution and the solution will be expelled from the solution cartridge 204. In one embodiment, the solution cartridge 204 is made from plastic. In another embodiment, the solution cartridge 204 is made from polyvinyl alcohol.

In another embodiment, the upper section 101*a* includes a pivot mixer shaft 106. In one embodiment, the pivot mixer shaft 205 is a triple helix shaped member. The pivot mixer shaft 205 will fit within the lower section 101*b* when the upper housing 101*a* is secured thereto. In one embodiment, the solution cartridge 204 comprises a plurality of pleated ribs therein, defining an accordion shape. This will allow for the solution cartridge 204 to properly collapse to dispense the solution.

Figure 9:
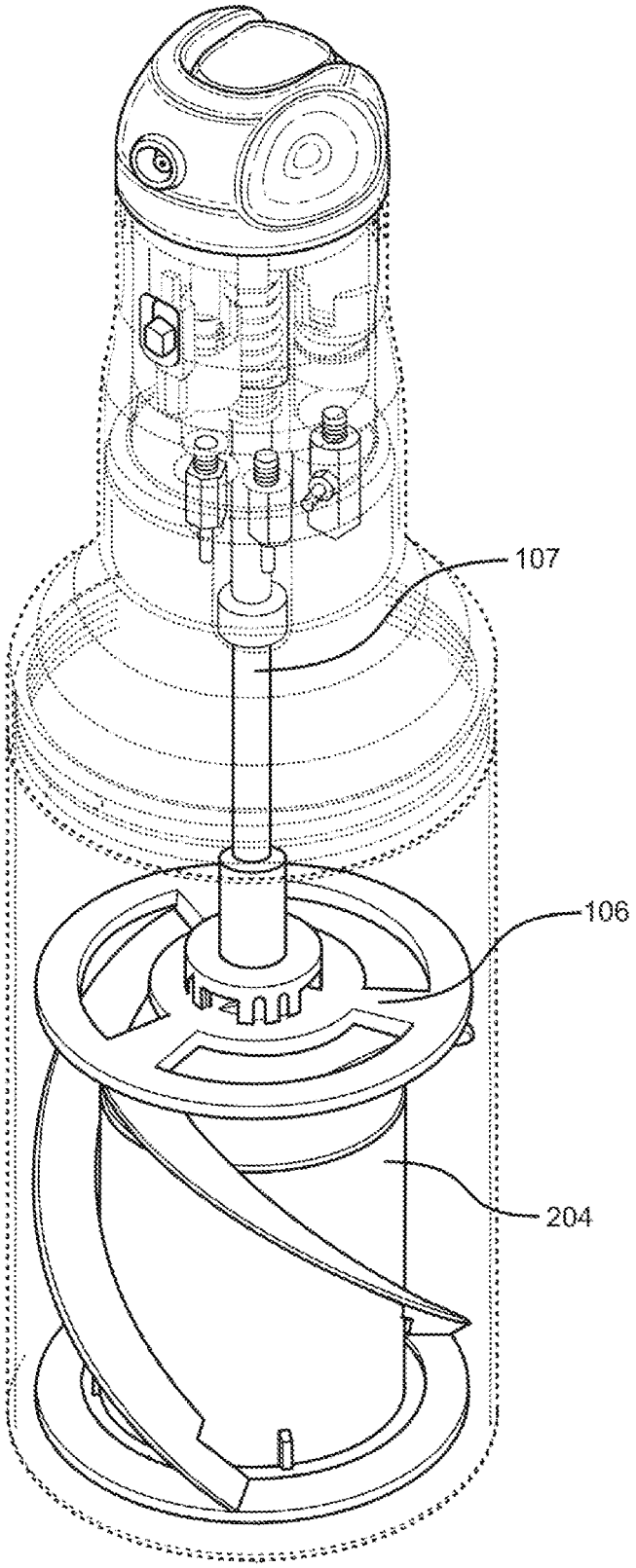
FIG. 9 shows an internal view of an alternative embodiment of the refillable solution dispensing device.

Referring now to FIG. 9, there is shown an internal view of an alternative embodiment of a refillable solution dispensing device. In this embodiment, the pivot mixer shaft 205 will encase the solution cartridge 204. When the actuator 103 is activated into the depression 103A, the pivot mixer shaft will be engaged. When the pivot mixer shaft 205 is engaged, the pivot mixer shaft 205 will crush the solution cartridge 204, thereby expelling the solution into the solution reservoir 203. Moreover, when engaged, the pivot mixer shaft 205 will mix the solution into the solution reservoir 203.

Another feature of the dispenser is the ability to have different configurations of the air chambers and the solution chambers. Just like the previous disclosure, in one embodiment the dispenser could have two air chambers and one solution chamber. In the shown embodiment, the dispenser has two solution chambers. This will allow for a larger amount of solution to be dispensed per pump. The single air chamber will help the solution be forced from the dispenser. It is contemplated by this disclosure that various combinations of the air chambers and the solution chambers exist which will dispense solution. This includes a combination of all one type of chamber.

In a further embodiment there are baffles that will prevent the solution from dispensing until a desired pressure is reached. This will particularly ensure that when spraying solution, the solution properly dispenses. This can further be used to ensure the proper amount of solution is dispensed. In one embodiment the baffles are secured in a closed position. The baffles will only open when the desired pressure is reached.

In another embodiment, an individual will open the refillable solution dispensing device 101. This occurs by removing the upper section 101A from the lower section 101B. Next a cartridge will be inserted into the lower section 101B. The refillable solution dispensing device 101 will then be closed. This will occur by coupling the upper section 101A from the lower section 101B. Next the dispenser will be filled to the proper level. At this point the next step will vary by dispenser type. In one embodiment the dispenser will then be shaken. The shaking will dissolve the solution cartridge 204 mixing the solution together. In another embodiment the actuator will be pressed. This will cause the mixing shaft 304 to rotate activating the mixer. The mixer will mix the water and dissolving the solution cartridge 204. This will allow the solution to be mixed together preparing for dispensing. Finally, the solution will be dispensed. Depending on the configurations of the air chambers and the solution chambers, the solution will be dispensed as a stream flow, a planar spray, a cloud spray, or a steam of liquid.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refillable solution dispensing device, the device comprising:

a housing having an upper section and a lower section, wherein a base of an upper section aligns with an upper edge of the lower section; whereby the upper section of the housing creates a seal with the lower section of the housing when the sections are affixed together;

the lower section comprising an interior volume that functions as a solution reservoir;

a solution cartridge disposed within the solution reservoir;

an opening through the upper section, wherein the opening is in fluid communication with the lower section;

the upper section comprising an actuator moveably exposed through the exterior of the upper section and the actuator is connected to the chambers on the interior of the upper section;

wherein the actuator will depress into the chambers when the actuator is moved into the upper section;

the plurality of chambers comprising at least an air chamber and a solution chamber;

wherein the plurality of chambers are configured from a group consisting of air chambers, solution chambers, and combination thereof;

wherein the solution chamber is in fluid communication with the solution reservoir and a discharge nozzle;

wherein the air chamber is in fluid communication with the solution reservoir and the discharge nozzle;

the actuator connected to a mixing shaft that protrudes into the lower section;

a solution mixer rotatably coupled to the mixing shaft;

wherein the solution mixer will rotate and combine the solutions and cartridge in the solution reservoir; and wherein engaging the actuator causes the combination of premixed prescribed solution and air within the chambers to exit through the discharge nozzle.

2. The solution dispensing device of claim 1, wherein the plurality of chambers further comprises a one way valve and a pressure valve; whereby the one way valve will allow air or solution or combination thereof to be drawn into the air chambers or solution chambers; whereby the pressure valve discharges the air or solution at prescribed pressure upon activating the actuator.

3. The solution dispensing device of claim 1, wherein the actuator body is secured to the upper section with the mixer shaft and the solution mixer is moveably affixed wherein the actuator body protrudes into the lower section.

4. The solution dispensing device of claim 3, wherein the end of actuator body rotatably opens the top of the solution cartridge when the upper section is attached to the lower section.

5. The solution dispensing device of claim 1, further comprising an output selector, wherein the output selector extends through the upper section and is operably coupled to the solution chamber, whereby the output selector adjusts the amount of solution emitted from the device on each activation of the actuator.

6. The solution dispensing device of claim 1, further comprising a bypass switch that enables the mixing shaft to operate without discharging air or solution, so to mix solutions, the water, and the water soluble solution cartridge within the solution reservoir.

7. The solution dispensing device of claim 1, further comprising a float device disposed on the interior of the housing.

8. The solution dispensing device of claim 7, wherein the float device will close the opening when a prescribed amount of solution is reached within the solution reservoir.

9. The solution dispensing device of claim 1, wherein the actuator body further comprises at least one spring which will return the actuator to an extended position after the actuator is activated.

10. The solution dispensing device of claim 1, wherein the actuator selected from a group consisting of a button, a trigger, a lever, and any combination thereof.

11. The solution dispensing device of claim 1, wherein the activation of the actuator enables an actuator body to compress the air and the solution to discharge out of the discharge nozzle via the pressure valve at the prescribed pressure.

12. The solution dispensing device of claim 1, wherein the mixing shaft is connected to the mixing device via a threading, and wherein the threading causes the mixing device to rotate upon an activation of the actuator.

13. The solution dispensing device of claim 1, wherein the mixing shaft is in fluid communication with the solution reservoir, whereby the mixing shaft further mixes the air or the solutions or a combination thereof in the solution reservoir.

14. The solution dispensing device of claim 1, wherein the mixing shaft is in fluid communication with the solution reservoir, whereby the mixing shaft extracts the air or the solution or a combination thereof from the solution reservoir to a chamber.

15. The solution dispensing device of claim 1, wherein the solution cartridge comprises:

a defined body;

wherein the defined body further comprises a plurality of pleated ribs;

whereby the plurality of pleated ribs allows the defined body to compress;

a specified quantity of solution;

wherein the specified quantity of solution further comprises a composite of solution mixtures; and a protective outer sealer encasing the defined body of the solution cartridge prior to use.

16. The solution dispensing device of claim 15, wherein the defined body of the solution cartridge further comprises a plurality of concentrate solution compartments, whereby the specified quantity of solution is separated prior to mixing.

17. The solution dispensing device of claim 15, wherein the defined body and the protective outer sealer of the solution cartridge are water soluble.

18. The solution dispensing device of claim 16, wherein the plurality of concentrates solution compartments include a composite mixture of alcohols, ethanol, oils, and water.

19. The solution dispensing device of claim 15, wherein the defined body of the solution cartridge is composed of varying formulas selected from a group consisting of polyvinyl alcohol, plastic, or a combination thereof.

20. The solution dispensing device of claim 15, further comprising a protective outer layer which is a biodegradable encasement that prevents moisture transmission through the solution cartridge prior to use.

* * * * *